US010507368B2

(12) United States Patent
Kikuchi et al.

(10) Patent No.: US 10,507,368 B2
(45) Date of Patent: Dec. 17, 2019

(54) BASEBALL OR SOFTBALL BAT

(71) Applicant: MIZUNO CORPORATION, Osaka (JP)

(72) Inventors: Kohei Kikuchi, Osaka (JP); Yohei Yamashita, Atlanta, GA (US); Brendan Troy Kays, Norcross, GA (US)

(73) Assignee: MIZUNO CORPORATION, Osaka (JP)

( * ) Notice: Subject to any disclaimer, the term of this patent is extended or adjusted under 35 U.S.C. 154(b) by 29 days.

(21) Appl. No.: 15/611,172

(22) Filed: Jun. 1, 2017

(65) Prior Publication Data

US 2018/0345102 A1 Dec. 6, 2018

(51) Int. Cl.

| | |
|---|---|
| ***A63B 59/51*** | (2015.01) |
| ***A63B 59/58*** | (2015.01) |
| ***A63B 102/18*** | (2015.01) |
| *A63B 60/08* | (2015.01) |

(52) U.S. Cl.

CPC ..... *A63B 59/51* (2015.10); *A63B 59/58* (2015.10); *A63B 60/08* (2015.10); *A63B 2102/18* (2015.10); *A63B 2209/02* (2013.01)

(58) Field of Classification Search

CPC ..... A63B 59/51; A63B 59/58; A63B 2102/18

See application file for complete search history.

(56) References Cited

U.S. PATENT DOCUMENTS

| | | | | |
|---|---|---|---|---|
| 8,632,428 | B2 * | 1/2014 | Burger | A63B 60/54 473/566 |
| 2009/0215560 | A1 * | 8/2009 | McNamee | A63B 60/06 473/567 |
| 2011/0281674 | A1 * | 11/2011 | Shindome | A63B 59/50 473/564 |

* cited by examiner

*Primary Examiner* — Jeffrey S Vanderveen

(74) *Attorney, Agent, or Firm* — Troutman Sanders LLP; Daniel T. Sharpe

(57) ABSTRACT

A bat according to the present disclosure includes a ball hitting portion, a grip portion, a tapered portion that connects the ball hitting portion and the grip portion together, and a restriction member. The ball hitting portion is internally hollowed. The restriction member is disposed inside the ball hitting portion. The restriction member is in the form of a ring. The restriction member is disposed such that a radial direction thereof is transverse to a longitudinal direction of the ball hitting portion.

8 Claims, 5 Drawing Sheets

BASEBALL OR SOFTBALL BAT

BACKGROUND OF THE INVENTION

Field of the Invention

The present disclosure relates to a baseball or softball bat. More specifically, the present disclosure relates to a baseball or softball bat having restitution performance close to a limit value.

Description of the Background Art

Conventionally, a bat described in U.S. Pat. No. 8,632,428 (Patent Document 1) is known. The bat described in Patent Document 1 includes a barrel, a handle, a transition region connecting the barrel and the handle, a central tube, and a restriction member. The barrel is internally hollowed. The central tube extends inside the barrel along a longitudinal axis of the barrel, and is located coaxially with the barrel. The restriction member is washer-shaped. The restriction member is positioned transverse to the longitudinal axis of the barrel. Deformation of the barrel is limited by the barrel coming into contact with the restriction member.

SUMMARY OF THE INVENTION

A bat according to the present disclosure includes a ball hitting portion, a grip portion, a tapered portion that connects the ball hitting portion and the grip portion together, and a restriction member. The ball hitting portion is internally hollowed. The restriction member is disposed inside the ball hitting portion. The restriction member is in the form of a ring. The restriction member is disposed such that a radial direction thereof is transverse to a longitudinal direction of the ball hitting portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, an embodiment of a bat according to the present disclosure will be described in detail with reference to the drawings. In the figures, identical or corresponding components are identically denoted. Furthermore, the embodiments described below may at least partially be combined together, as desired.

(Configuration of Bat According to Embodiment)

Hereinafter, a configuration of a bat according to an embodiment will be described.

Figure 1:
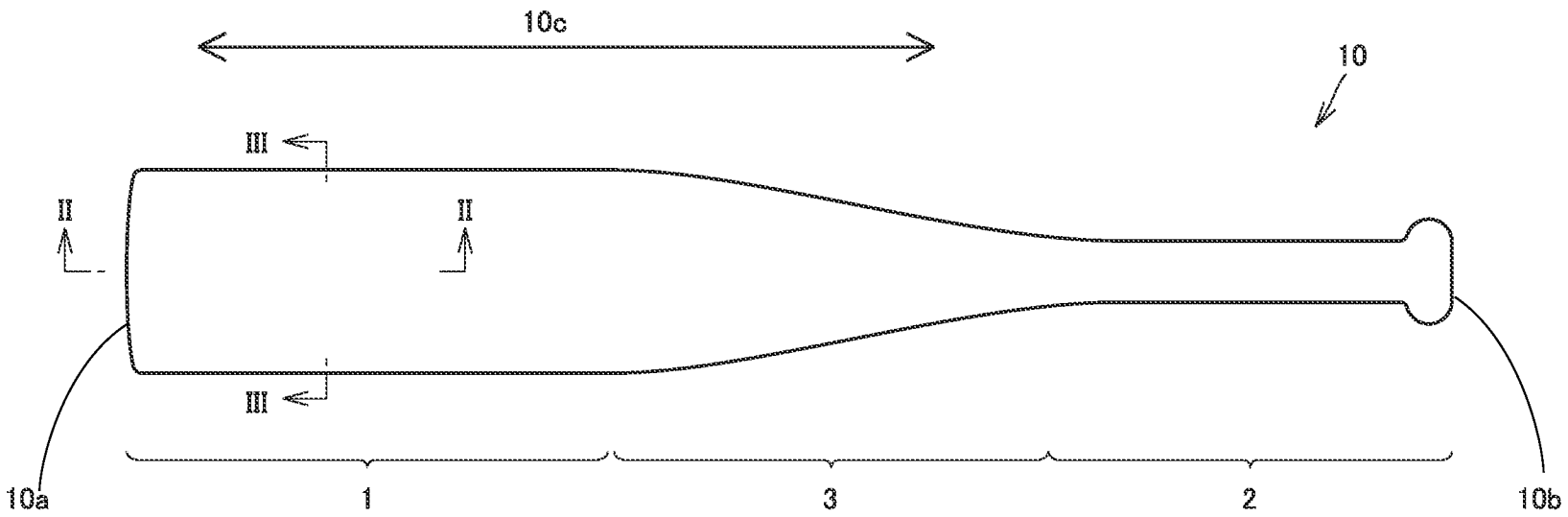
FIG. 1 is a side view of a bat according to an embodiment.

The bat according to the embodiment is a baseball or softball bat for example. FIG. 1 is a side view of a bat 10 according to the embodiment. As shown in FIG. 1, bat 10 according to the embodiment has a first end 10*a* and a second end 10*b*. First end 10*a* is an end of bat 10 according to the embodiment on the side of the head. Second end 10*b* is an end opposite to the first end. That is, second end 10*b* is an end of bat 10 according to the embodiment on the side of the grip end. The bat according to the embodiment is configured to extend in a longitudinal direction 10*c*. Longitudinal direction 10*c* is a direction extending from second end 10*b* toward first end 10*a*. Longitudinal direction 10*c* is indicated by an arrow in FIG. 1.

Bat 10 according to the embodiment has a ball hitting portion 1, a grip portion 2, and a tapered portion 3. Ball hitting portion 1 is a portion for hitting a ball. Ball hitting portion 1 is located on the first end 10*a* side. Grip portion 2 is a portion that a batter grips during use. Grip portion 2 is located on the second end 10*b* side. Tapered portion 3 is a portion connecting ball hitting portion 1 and grip portion 2 together. Ball hitting portion 1 is larger in thickness than grip portion 2. The tapered portion is tapered from the ball hitting portion 1 side toward the grip portion 2 side.

Ball hitting portion 1, grip portion 2 and tapered portion 3 are mainly formed of FRP. For example, FRP is composed of thermosetting resin and reinforcing fiber. The reinforcing fiber contained in FRP is, for example, carbon fiber. However, the reinforcing fiber is not limited thereto. The reinforcing fiber may be glass fiber. The thermosetting resin composing the FRP is, for example, epoxy resin. However, the thermosetting resin is not limited thereto. Ball hitting portion 1, grip portion 2 and tapered portion 3 may be formed by laminating a plurality of FRP layers. Each layer of FRP may have its reinforcing fibers oriented differently than the other layers of FRP.

Figure 2:
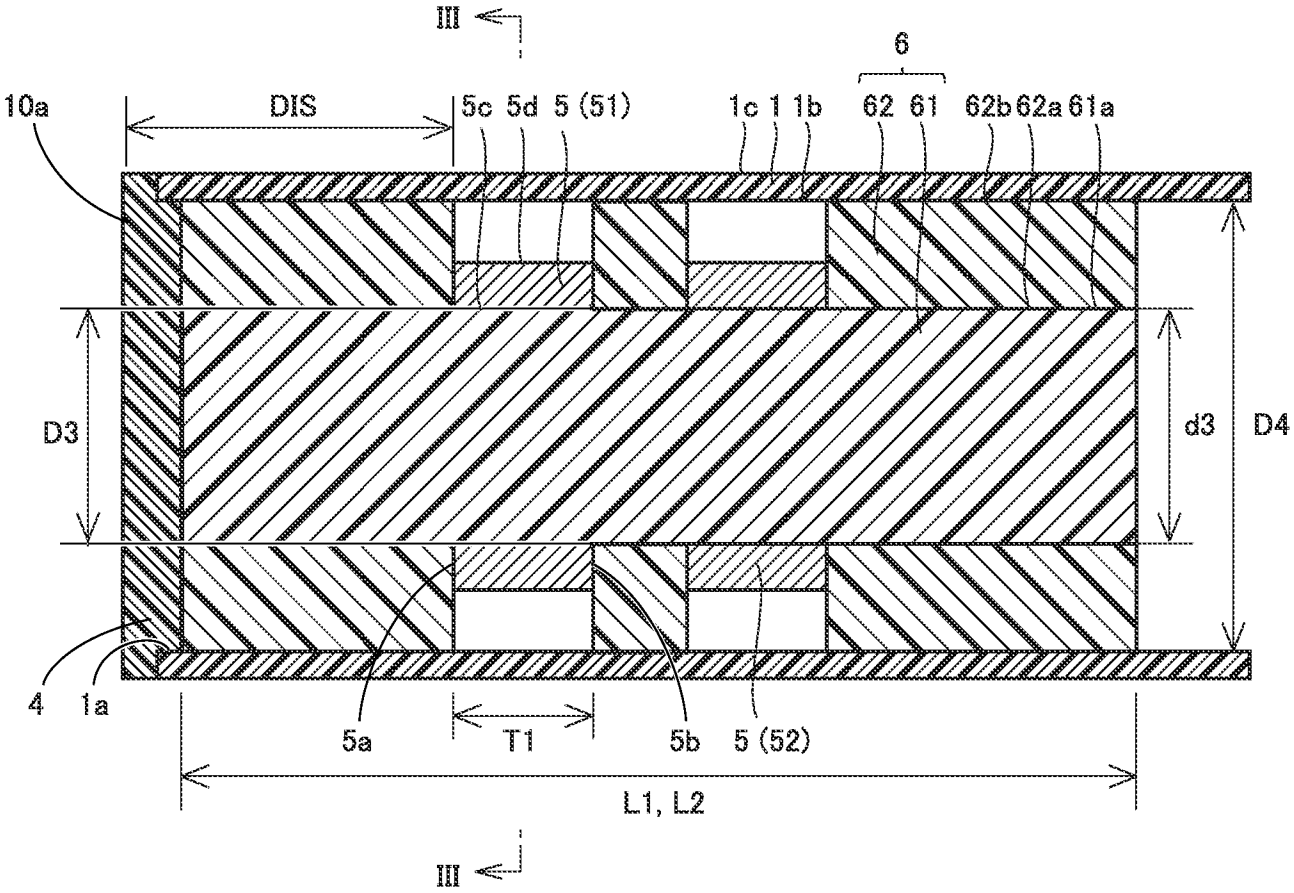
FIG. 2 is a cross-sectional view taken along a line II-II of FIG. 1.
Figure 3:
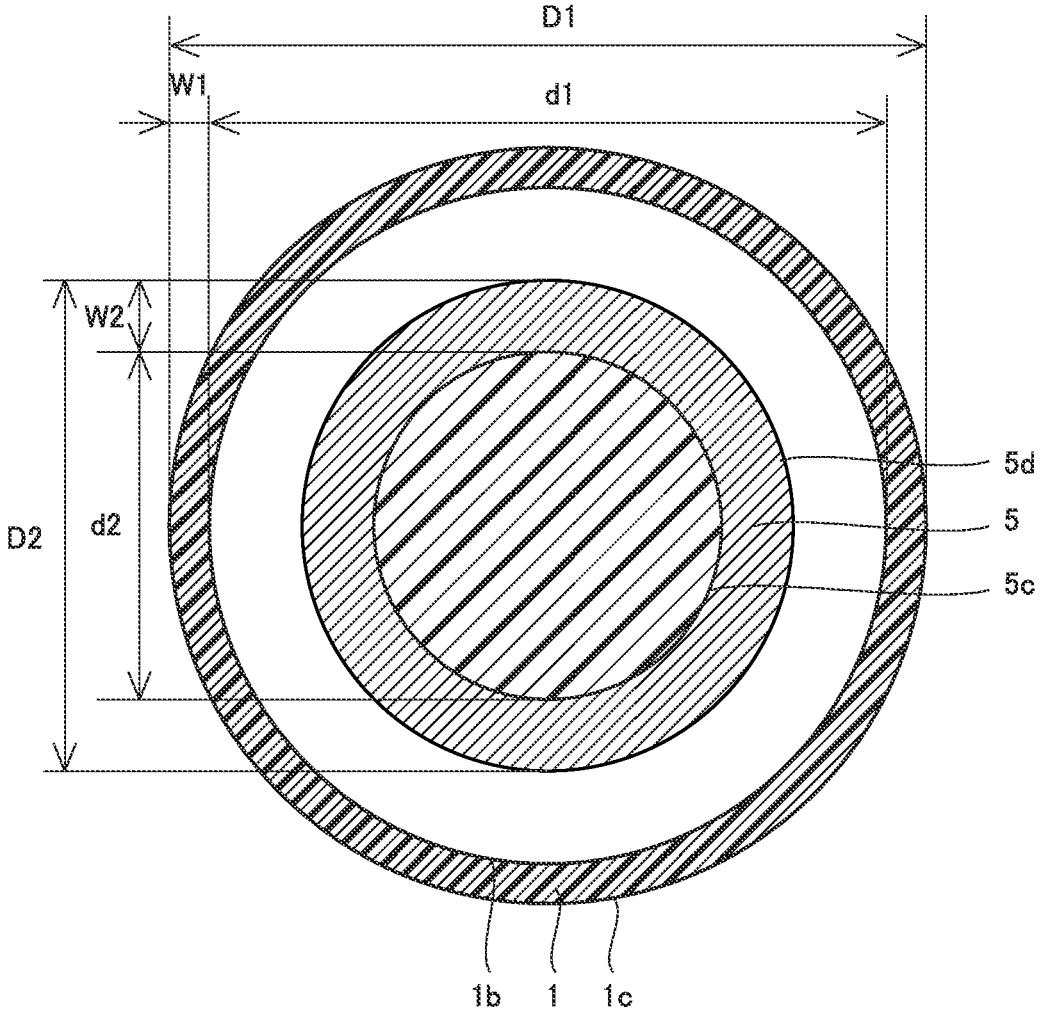
FIG. 3 is a cross-sectional view taken along a line III-III of FIG. 1.

FIG. 2 is a cross-sectional view taken along a line II-II of FIG. 1. FIG. 3 is a cross-sectional view taken along a line III-III of FIG. 1. As shown in FIGS. 2 and 3, ball hitting portion 1 has an interior partially hollowed. Grip portion 2 and tapered portion 3 may each also have an interior partially hollowed. Ball hitting portion 1 may have an opening 1*a* at first end 10*a*. Bat 10 according to the embodiment may have a lid 4. Lid 4 is fitted into opening 1*a*.

Ball hitting portion 1 has an inner circumferential surface 1*b* and an outer circumferential surface 1*c*. Ball hitting portion 1 has an inner diameter d1, an outer diameter D1, and a thickness W1. Thickness W1 is a distance between inner circumferential surface 1*b* and outer circumferential surface 1*c*. When bat 10 according to the embodiment is a baseball bat, inner diameter d1 is 45 mm or more and 70 mm or less, for example, and outer diameter D1 is 55 mm or more and 75 mm or less, for example. When bat 10 according to the embodiment is a softball bat, inner diameter d1 is 50 mm or more and 60 mm or less, for example, and outer diameter D1 is 50.5 mm or more and 70 mm or less. Thickness W1 is selected as appropriate depending on a coefficient of restitution as desired.

Bat 10 according to the embodiment has a restriction member 5. Restriction member 5 is disposed inside ball hitting portion 1. Restriction member 5 may be disposed such that restriction member 5 and ball hitting portion 1 have their respective central axes matching each other. Restriction member 5 is not limited in number. Restriction member 5 may be single in number. Restriction member 5 may be plural in number. Restriction member 5 is formed of a material such as a metal material, FRP, or other resin for example. The metal material used for restriction member 5 includes aluminum, an aluminum alloy, titanium, a titanium alloy, magnesium, a magnesium alloy, steel, iron for example.

Restriction member 5 is disposed in a vicinity of a sweet spot of ball hitting portion 1. More specifically, as shown in FIG. 2, when two restriction members 5 are provided, restriction member 5 closest to first end 10*a* is referred to as a first restriction member 51, and the other restriction member 5 is referred to as a second restriction member 52. In that case, first restriction member 51 is disposed at a position distant from first end 10*a* by a distance DIS. Distance DIS is a distance from first end 10*a* in longitudinal direction 10*c*. Distance DIS is, for example, 75 mm or more and 200 mm or less. Distance DIS may be 100 mm or more and 175 mm or less.

Restriction member 5 is in the form of a ring. That is, restriction member 5 has an annular shape in a plane view as viewed from the first end 10*a* side. It suffices that restriction member 5 has a substantially annular shape in a plane view. For example, restriction member 5 may have an elliptically annular shape in a plane view.

Restriction member 5 has a top surface 5*a* and a bottom surface 5*b*. Top surface 5*a* intersects longitudinal direction 10*c*. Preferably, top surface 5*a* is a surface orthogonal to longitudinal direction 10*c*. Bottom surface 5*b* is a surface opposite to top surface 5*a*. Restriction member 5 has an inner circumferential surface 5*c* and an outer circumferential surface 5*d*. Inner circumferential surface 5*c* is a surface opposite to outer circumferential surface 5*d*. Restriction member 5 has a length T1 and a thickness W2. Restriction member 5 has an inner diameter d2 and an outer diameter D2.

Length T1 is a distance between top surface 5*a* and bottom surface 5*b*. Thickness W2 is a distance between inner circumferential surface 5*c* and outer circumferential surface 5*d*. Outer diameter D2 is smaller than inner diameter d1. In other words, outer circumferential surface 5*d* is not in contact with inner circumferential surface 1*b*.

Length T1, thickness W2, inner diameter d2, and outer diameter D2 are appropriately selected with restriction member 5 considered in rigidity and weight. Length T1 is, for example, 3.5 mm or more and 15.0 mm or less. Inner diameter d2 is, for example, 25.0 mm or more and 45.0 mm or less. Outer diameter D2 is, for example, 38.0 mm or more and 60.0 mm or less. Thickness W2 is, for example, 4.3 mm or more and 15.0 mm or less. The difference between outer diameter D2 and inner diameter d1 affects an amount by which ball hitting portion 1 deflects when a ball impacts it. That is, the difference between outer diameter D2 and inner diameter d1 affects the coefficient of restitution of ball hitting portion 1. Accordingly, the difference between outer diameter D2 and inner diameter d1 is appropriately selected according to a coefficient of restitution as desired.

Restriction member 5 is disposed such that a radial direction thereof is transverse to longitudinal direction 10*c*. Restriction member 5 may be disposed such that a radial direction thereof is orthogonal to longitudinal direction 10*c*. From a different viewpoint, restriction member 5 may be disposed such that a lengthwise direction thereof is along longitudinal direction 10*c*. From another viewpoint, restriction member 5 may be disposed such that outer circumferential surface 5*d* faces inner circumferential surface 1*b* of ball hitting portion 1. The lengthwise direction refers to a direction from top surface 5*a* toward bottom surface 5*b*, and the radial direction refers to a direction from inner circumferential surface 5*c* toward outer circumferential surface 5*d*.

Bat 10 according to the embodiment may have a core member 6. Core member 6 is disposed inside ball hitting portion 1. Core member 6 is disposed around restriction member 5. When this is seen from another viewpoint, restriction member 5 is disposed such that it is covered with core member 6. Further, restriction member 5 is positionally fixed inside ball hitting portion 1 by core member 6. Core member 6 may have a cylindrical shape.

Core member 6 may have a first core member 61 and a second core member 62. First core member 61 may have a cylindrical shape. First core member 61 has an outer circumferential surface 61*a*. The first core member has an outer diameter D3. Second core member 62 may have a cylindrical shape. Second core member 62 has an inner circumferential surface 62*a* and an outer circumferential surface 62*b*. Second core member 62 has an inner diameter d3 and an outer diameter D4.

First core member 61 is disposed inside restriction member 5. Outer circumferential surface 61*a* of first core member 61 may be in contact with inner circumferential surface 5*c* of restriction member 5. Outer circumferential surface 61*a* of first core member 61 may be in contact with inner circumferential surface 62*a* of second core member 62. In other words, outer diameter D3 and inner diameter d3 may be equal. Second core member 62 is disposed outside first core member 61. In other words, first core member 61 is inserted inside second core member 62. Second core member 62 may have an outer circumferential surface in contact with inner circumferential surface 1*b* of ball hitting portion 1. Outer diameter D4 may be equal to inner diameter d1.

First core member 61 has a length L1, and second core member 62 has a length L2. Length L1 is a length of first core member 61 in longitudinal direction 10*c*. Length L2 is a length of second core member 62 in longitudinal direction 10*c*. Length L1 may be equal to length L2. Length L1 may be different from length L2. Length L1 and length L2 are, for example, 120.0 mm or more and 300.0 mm or less.

Outer diameter D3 is, for example, 25.0 mm or more and 45.0 mm or less. Outer diameter D4 is 40.0 mm or more and 60.0 mm or less.

First core member 61 and second core member 62 may be of resin. When first core member 61 and second core member 62 are made of resin, first core member 61 and second core member 62 are made, for example, of EVA (ethylene vinyl acetate copolymer resin), butadiene rubber, ionomer or a similar thermoplastic elastomer. First core member 61 and second core member 62 may be formed of thermoplastic resin for example.

First core member 61 may be larger in hardness than second core member 62. First core member 61 may have an Asker C hardness of 30 or more and 60 or less. Second core member 62 may have an Asker C hardness of 10 or more and 30 or less. Note that Asker C hardness is an index in hardness of resin defined in the Society of Rubber Industry, Japan Standard SRIS0101.

First core member 61 may be higher in density than second core member 62. First core member 61 may have a density of 0.05 g/cm$^3$ or more and 1.26 g/cm$^3$ or less. Second core member 62 may have a density of 0.02 g/cm$^3$ or more and 0.16 g/cm$^3$ or less.

(Method for Producing Bat According to Embodiment)

Hereinafter, a method for producing bat 10 according to an embodiment will be described.

Figure 4:
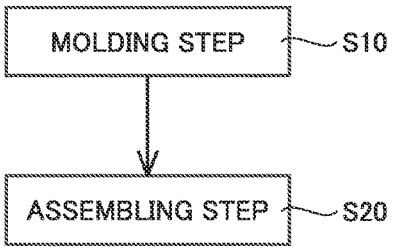
FIG. 4 is a flowchart showing a method for producing a bat according to an embodiment.

FIG. 4 is a flowchart showing the method for producing bat 10 according to the embodiment. As shown in FIG. 4, the method for producing bat 10 according to the embodiment includes a molding step S10 and an assembling step S20.

In the molding step S10, ball hitting portion 1, grip portion 2 and tapered portion 3 are molded. In the molding step S10, initially, a prepreg (a sheet-like member which contains reinforcing fiber impregnated with uncured thermosetting resin) is wound around a mandrel.

Secondly, the mandrel is removed from the wound prepreg. Thirdly, a tube is inserted into the wound prepreg. Fourthly, the wound prepreg is placed inside a die. Fifthly the prepreg is heated. In doing so, the prepreg is compressed externally and internally by the die and the tube. The prepreg is thus set, and ball hitting portion 1, grip portion 2 and tapered portion 3 are thus molded.

After the molding step S10, the assembling step S20 is performed. In the assembling step S20, restriction member 5 and core member 6 are inserted into ball hitting portion 1. Restriction member 5 and core member 6 are inserted through opening 1*a* of ball hitting portion 1. After restriction member 5 and core member 6 are inserted, lid 4 is fitted in opening 1*a*. This completes production of bat 10 according to the embodiment.

(Effect of Bat According to Embodiment)

Hereinafter, an effect of bat 10 according to the embodiment will be described.

As a ball impacts ball hitting portion 1 repeatedly, the coefficient of restitution of ball hitting portion 1 varies. Particularly, in a case where ball hitting portion 1 is formed of FRP, a ball repeatedly impacting ball hitting portion 1 delaminates the FRP. When ball hitting portion 1 has the FRP delaminated, ball hitting portion 1 is reduced in rigidity when it is annularly compressed. As a result, the bat's coefficient of restitution increases.

Competitive sports organizations such as the ASA (American Softball Association), etc. require that bats for competitive sports games pass the ABI (Accelerated Barrel Break-in Procedures) test to prevent bats having excessive coefficients of restitution from being used in competitive sports games. The ABI test requires that a bat has a coefficient of restitution less than a predetermined numerical value even after FRP is delaminated. Accordingly, conventionally, bats have been designed to lower a coefficient of restitution in an initial state so that the coefficient of restitution is less than the predetermined numerical value even after FRP is delaminated.

When bat 10 according to the embodiment is impacted by a ball at ball hitting portion 1 the impact deforms ball hitting portion 1, and accordingly, inner circumferential surface 1*b* contacts restriction member 5. As a result, the deformation of ball hitting portion 1 is suppressed by restriction member 5. As such, even when a ball impacts ball hitting portion 1 repeatedly and the FRP is delaminated, ball hitting portion 1 will never have a significantly increased coefficient of restitution. Bat 10 according to the embodiment can thus satisfy the requirement of the ABI test without designing to reduce a coefficient of restitution in an initial state. That is, bat 10 according to the embodiment allows setting in the initial state a coefficient of restitution close to that after FRP is delaminated, that is tolerated in the ABI test.

Figure 5:
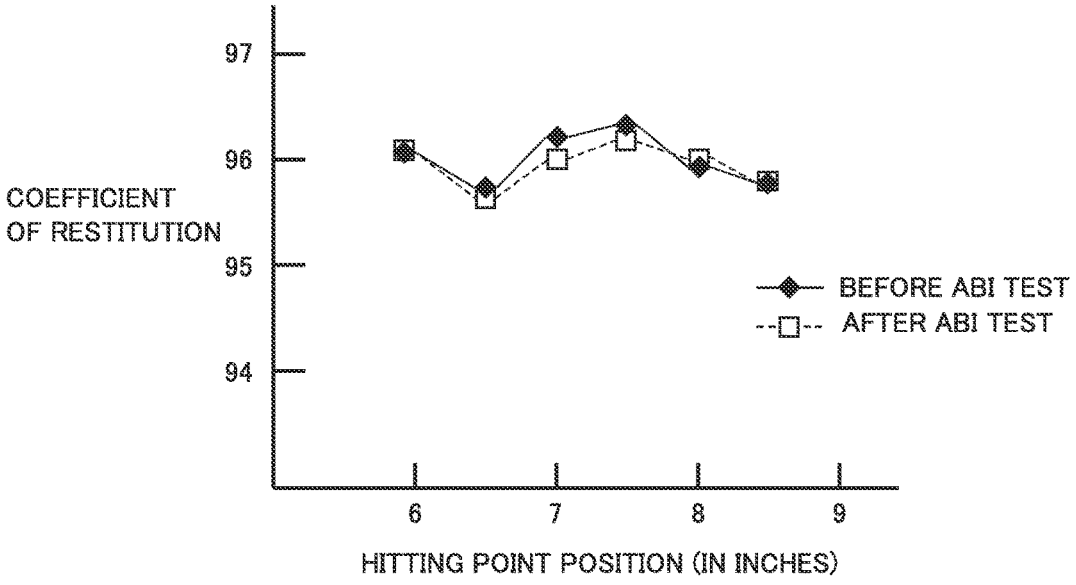
FIG. 5 is a graph representing a coefficient of restitution of a bat according to an embodiment before and after an ABI test.
Figure 6:
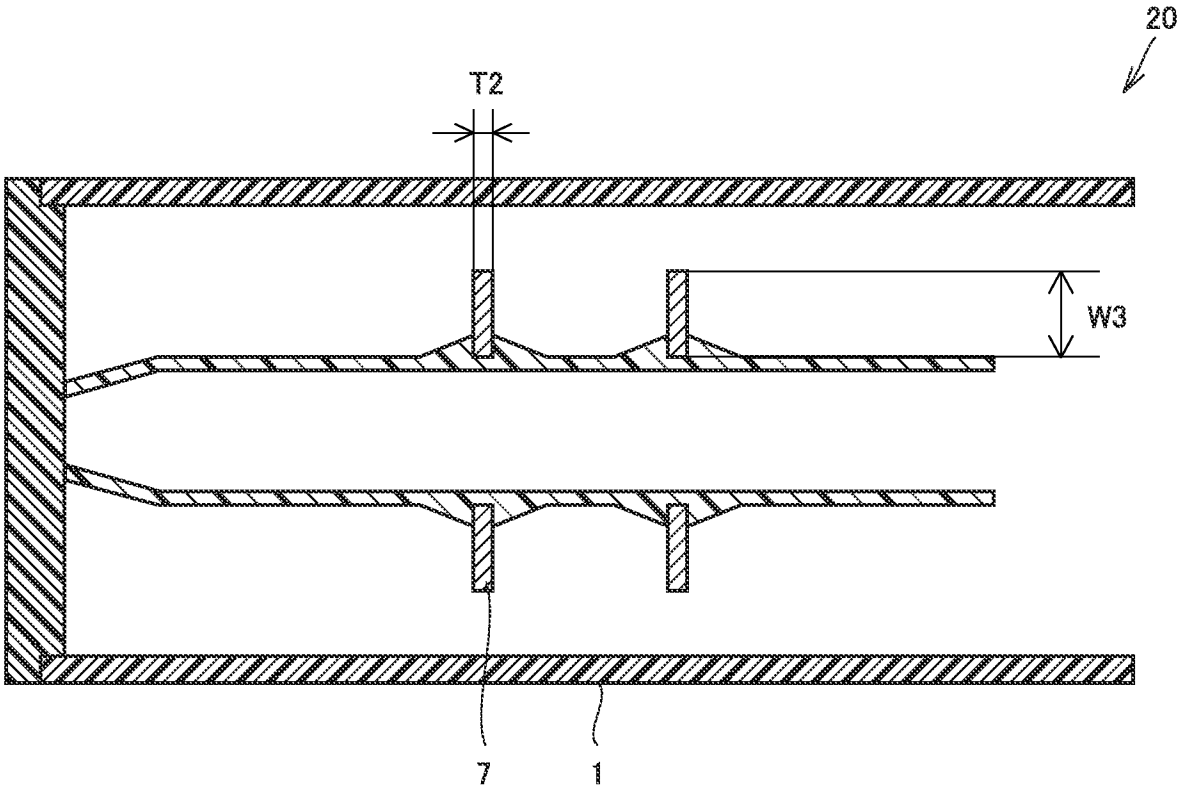
FIG. 6 is a cross-sectional view of a bat according to a comparative example in a longitudinal direction thereof.

FIG. 5 is a graph representing how a coefficient of restitution of bat 10 according to the embodiment varies between before and after the ABI test. In FIG. 6, the axis of abscissa represents a hitting point position. The hitting point position is represented by a distance from first end 10*a*. In FIG. 6, the axis of ordinate represents a coefficient of restitution. The ABI test is conducted under conditions as published by competitive sports organizations, respectively, such as ASA, and a coefficient of restitution is measured according to ASTM 2219.

As shown in FIG. 5, bat 10 according to the embodiment shows equivalent coefficients of restitution before and after the ABI test. That is, bat 10 according to the embodiment suppresses an increase of a coefficient of restitution even after FRP is delaminated. Thus it has also been confirmed through an experiment that bat 10 according to the embodiment suppresses an increase of a coefficient of restitution even after FRP is delaminated.

Hereinafter, another effect of bat 10 according to the embodiment will be described, as compared with a comparative example.

FIG. 6 is a cross-sectional view of a bat 20 according to a comparative example in longitudinal direction 10*c*. As shown in FIG. 6, bat 20 according to the comparative example has a washer member 7 disposed inside ball hitting portion 1. Washer member 7 is disposed in ball hitting portion 1 in a vicinity of a sweet spot.

Washer member 7 has a length T2 and a thickness W3. Washer member 7 has a washer-like shape. In other words, washer member 7 is in the form of an annular sheet.

When bat 20 according to the comparative example is impacted by a ball at ball hitting portion 1, inner circumferential surface 1*b* of ball hitting portion 1 contacts washer member 7. As has been discussed above, since washer member 7 has a washer-like shape (i.e., washer member 7 has length T2 smaller than thickness W3), a large stress concentration occurs in a vicinity of a portion where inner circumferential surface 1*b* of ball hitting portion 1 and washer member 7 are in contact with each other. As a result, bat 20 according to the comparative example may be impaired in durability.

On the other hand, bat 10 according to the embodiment has restriction member 5 as described above. Restriction member 5 is in the form of a ring. Therefore, when inner circumferential surface 1*b* of ball hitting portion 1 contacts restriction member 5, a stress concentration does not easily occur in a vicinity of a portion where inner circumferential surface 1*b* of ball hitting portion 1 and the restriction member are in contact with each other. Bat 10 according to the embodiment can thus be improved in durability while suppressing an increase of a coefficient of restitution caused by delamination of FRP.

Hereinafter, an effect of bat 10 according to the embodiment will more specifically be described.

When bat 10 has core member 6 the position of restriction member 5 inside ball hitting portion 1 can be restricted.

When core member 6 has first core member 61 and second core member 62 and first core member 61 is larger in hardness than second core member 62, core member 6 can be inserted into ball hitting portion 1 with second core member 62 easily deformed. Thus, core member 6 can be easily inserted.

When first core member 61 is larger in hardness than second core member 62, and a ball impacts ball hitting portion 1, second core member 62 easily deforms, whereas first core member 61 does not easily deform. Thus, first core member 61 restrains deformation of the restriction member 5 from inside.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A bat comprising:

an internally hollow, ball hitting portion having an inner diameter;

a grip portion;

a tapered portion connecting the ball hitting portion and the grip portion together;

a restriction member disposed inside the ball hitting portion in a form of a ring, wherein the restriction member has a length in an axial direction of the bat that is between 3.5 mm and 15.0 mm and a thickness in a radial direction such that the length is greater than the thickness;

a core member disposed inside the ball hitting portion and positionally fixing the restriction member; and wherein prior to an external impact the inner diameter of the ball hitting portion is greater than an outer diameter of the restriction member.

2. The bat according to claim 1, wherein the ball hitting portion is formed of fiber-reinforced plastic.

3. The bat according to claim 1, wherein the core member comprises:

a first core member disposed inside the restriction member; and a second core member disposed outside the first core member, wherein the second core member abuts the restriction member on at least two opposite faces of the restriction member in order to positionally fix the restriction member in the axial direction of the bat.

4. The bat according to claim 3, wherein the first core member is larger in hardness than the second core member.

5. The bat according to claim 3, wherein the first core member is larger in density than the second core member.

6. The bat according to claim 1, wherein the restriction member is formed of a metal material, fiber-reinforced plastic, or resin.

7. The bat according to claim 1, wherein prior to an external impact the inner diameter of the ball hitting portion is at least 5 mm greater than an outer diameter of the restriction member.

8. The bat according to claim 1, wherein the restriction member has a coefficient of restitution sufficient to suppress the deformation of the ball hitting portion.

* * * * *